United States Patent [19]

Leem

[11] Patent Number: 4,560,297

[45] Date of Patent: Dec. 24, 1985

[54] WRITING IMPLEMENT

[76] Inventor: Tae Yoon Leem, 52-204, Walker Hill Apt., Kawngjang-dong, Sungdong-Ku, Seoul, Rep. of Korea

[21] Appl. No.: 508,655

[22] Filed: Jun. 28, 1983

[30] Foreign Application Priority Data

Jul. 2, 1982 [KR] Rep. of Korea ..... 5204/1982

[51] Int. Cl.[4] ..... B43K 21/08; B43K 27/00

[52] U.S. Cl. ..... 401/31; 401/34; 401/75; 401/76; 401/116

[58] Field of Search ..... 401/31, 34, 74, 75, 401/76, 79, 116

[56] References Cited

U.S. PATENT DOCUMENTS

| | | | |
|---|---|---|---|
| 1,490,245 | 4/1924 | Wahl | 401/76 |
| 2,411,975 | 12/1946 | Nelson | 401/75 |
| 2,595,001 | 4/1952 | Sams et al. | 401/74 |
| 4,136,980 | 1/1979 | Leem | 401/31 |

FOREIGN PATENT DOCUMENTS

| | | | |
|---|---|---|---|
| 573206 | 6/1924 | France | 401/75 |
| 112031 | 10/1944 | Sweden | 401/76 |

*Primary Examiner*—Steven A. Bratlie
*Attorney, Agent, or Firm*—Holman & Stern

[57] ABSTRACT

A writing implement has a carrier for guiding a pencil lead forward and/or backward at both ends of a pencil barrel wherein the movement of the carrier is produced by rotating a cap to which a cap holder and a supporting member are integrally connected and the supporting member is provided with stop jaws for preventing an excess back movement of the carrier at the inner end of the supporting member.

4 Claims, 2 Drawing Figures

WRITING IMPLEMENT

BACKGROUND OF THE INVENTION

1. Field of the Invention

This invention relates to an improvement in a double-ended mechanical writing implement in which backward and forward movements are controlled by a carrier having a spiral guide traveling along the spiral groove provided on the inside of a pencil barrel in response to the mechanical rotations of the cap holding one end of a lead supporting member. More particularly, this invention relates to an improvement in the structure of the cap and the carrier mentioned above.

2. Description of the Prior Art

A writing implement of this type was disclosed in U.S. Pat. No. 4,136,980 granted to the present inventor. In this implement, since a carrier of the pencil lead does not have an absolutely circular form, but a part annular form, a stable support of the lead could not be assured. Furthermore, the implement has a drawback in that a spiral guide defined on the outside of the carrier is naturally decreased in its whole length and, thus, the spiral guide cannot precisely be engaged with a spiral groove formed on the inside of the pencil barrel when the inner diameter of the barrel is either larger or shorter than that of a standard position. This is likely to cause the spiral guide to be removed from the spiral grooves.

Since the pencil barrel of the writing implement of such a type should be molded of a suitable synthetic resin by either an extruding or injection process, in the case of extrusion molding, there would be produced an error in the inner diameter of the barrel extruded ranging from 0.05 to 0.15 mm, while in the case of injection molding, such an error would not occur.

However, when the pencil barrel is extruded, the inside of the barrel must be tapered in order to facilitate the release of the outward and inward molds after completing the molding procedures. Therefore, it has been desired to provide such a writing implement with a carrier having a structure suitable to be precisely engaged with the spiral groove on the inside of the barrel. In addition, since the prior art writing implement has a neutral border member in the middle part of the inside of the barrel in order to prevent the carrier from a back movement, the carrier is apt to be excessively pushed backward when it is subjected to a back movement.

SUMMARY OF THE INVENTION

The primary object of the invention is to provide an improvement in the construction of the prior art writing implement aforementioned.

Another object of the invention is to provide a writing implement having double ends in which the pencil lead carrier will not move excessively toward the opposite end.

These and other objects can be attained by a writing implement in accordance with the invention comprising a cap rotatably fitted to each end of a pencil barrel, said cap including a cap holder and a supporting member positioned in the barrel, and a carrier having a spiral guide formed on the outside of the carrier, characterized by providing stop jaws at the bottom end of said supporting member.

BRIEF DESCRIPTION OF THE DRAWINGS

The invention will further be described hereinafter with reference to the accompanying drawings wherein.

DETAILED DESCRIPTION

Figure 1:
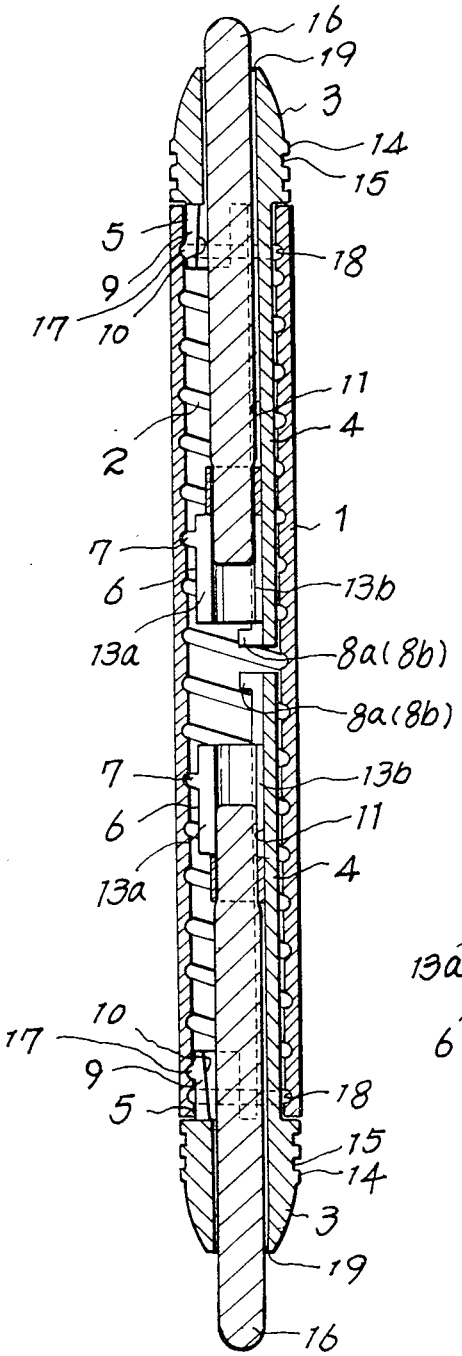
FIG. 1 is a longitudinal cross-sectional view of the writing implement of the invention.
Figure 2:
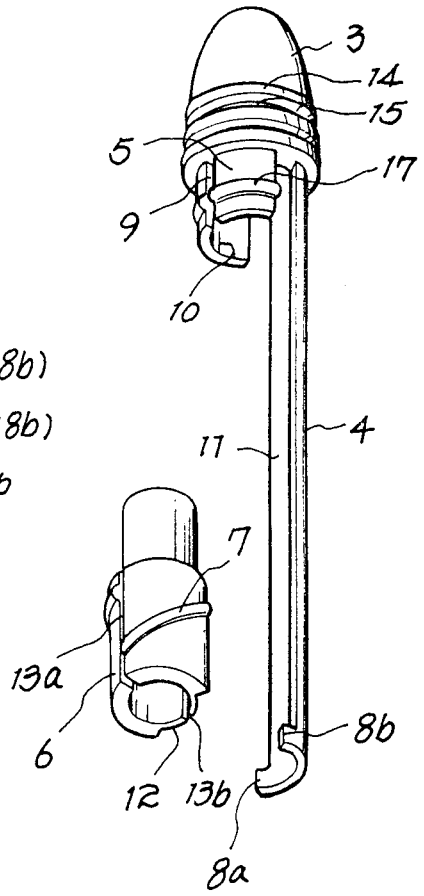
FIG. 2 is an exploded perspective view of parts of the writing implement shown in FIG. 1, illustrating how the principal elements of the implement function.

Referring now to FIGS. 1 and 2, a pencil barrel 1 made of a synthetic resin has a spiral groove 2 in the inner wall of the barrel 1. A cap 3 which includes a supporting member 4 and a cap holder 5 positioned in the barrel is rotably fitted to each end of the barrel 1. A carrier 6 is provided with a rounded spiral guide 7 on the outward surface thereof, which spiral guide is engaged with and travels along the spiral groove 2 in the pencil barrel 1. At the bottom end of the supporting member 4, stop jaws 8*a*, 8*b* are formed. The cap holder 5 has a slot 9 which is cut away longitudinally at the center portion thereof, in order to produce resilient force from the holder 5. The inner wall 10 of the holder 5 is slightly tapered downward and the carrier 6 is shaped in the form of an annular tube. However, at the portion of the carrier 6 which contacts on its outer surface with the concaved portion 11 on the inner surface of the supporting member 4, a recess 12 corresponding to the portion 11 is formed. In addition, slows 13*a*, 13*b* are provided along the length of the carrier 6, so that the carrier can produce resilient force. Around the circumference of the cap 3, several protrusions 14 and grooves 15 are formed horizontally as viewed in FIG. 1 in order to provide a means for preventing slipping when rotating the cap 3 with fingers. The reference symbols 16, 17 and 18 depict respectively a pencil lead, a protruding holding member formed on the outside surface of the cap holder 5, and a recess with which the member 17 is rotatably engaged.

In operating the implement, when the cap 3 is rotated, the supporting member 4 rotates accordingly and thereby forces the carrier 6 to rotate in the same direction of the cap 3 by means of contacting the recess 12 in the carrier 6 with the concaved portion 11 of the supporting member 4. Rotation of the carrier 6 causes the rounded spiral guide 7 formed on the outside of the carrier 6 to travel along the spiral groove 2 on the inside of the pencil barrel 1. By this operation, the pencil lead 16 can move forward or backward with respect to the lead opening 19, as is done in conventional mechanical pencils.

In the meanwhile, the writing implement thus construted has stop jaws 8*a*, 8*b* at the inner end of the supporting member 4 and therefore the carrier 6 can move inwardly only until the opposite end of the carrier 6 is contacted with the stop jaws 8*a*, 8*b* and can no longer be guided.

Therefore, the writing implement of the invention will prevent the carrier 6 from excess backward movement without installing a neutral border member as necessarily required in prior art mechanical pencils such as those disclosed in U.S. Pat. No. 4,136,980.

In addition, since the cap 3 is provided with a cap holder 5 having a slot 9 producing resilient force, when the cap 5 is assembled in or disassembled out of the pencil barrel 1, it can easily be capped or removed. Furthermore, the pencil lead 16 will not readily be broken by compressive force when inserting the cap holder 5 into the pencil barrel 1, because the inner wall 10 of the holder 5 is adequately tapered.

The present invention also has an advantage in that even though the inner diameter of the pencil barrel 1 is not uniform over its whole length, the spiral guide 7 provided on the outside of the carrier can smoothly but tightly be engaged with the spiral groove 2 on the inside of the barrel 1, due to the resilient function of the slots 13*a*, 13*b* formed in the body of the carrier 6. Furthermore, several slip-preventing means 14 and 15 are provided horizontally on the outside of the cap 3 and thus, it is possible to precisely rotate the cap 3 and assemble or disassemble the writing implement.

Although the present invention has been described with respect to a specific embodiment by referring to the accompaning drawings, it should be noted that the invention can be modified by those skilled in the art within the spirit and scope of the invention.

What is claimed is:

1. In a writing implement having an elongated hollow barrel with an inner wall surface, a spiral groove on the inner wall surface, a cap rotatably attachable to one end of the barrel, a bore through the cap coaxial with the central axis of the barrel to slidingly receive a writing element therein, a part annular elongated supporting member having longitudinal edges attached at the outer end to the cap and extending from the cap into the hollow barrel to be rotated within the barrel by rotation of the cap, a carrier within the barrel adapted to engage with the writing element, and a guide element projecting from the outer surface of the carrier engaging in the spiral groove, the carrier engaging with the supporting member so that rotation of the cap and supporting member with respect to the barrel drives said carrier rotatably and axially in said barrel to move the writing element in both directions through the cap, the improvement comprising:

the carrier is in the form of a cylindrical tubular member having inner and outer ends and in which the writing element is receivable in gripping engagement therewith;

a part annular recess in the outer surface of the carrier substantially conforming to and slidably receiving therein the part annular supporting member, said recess forming axially extending shoulders engageable in abutting relationship with the longitudinal edges of the support member; and at least one carrier stop element extending part circumferentially from at least one of the longitudinal edges of the support member engageable with said inner end of the carrier to limit the travel of said carrier inwardly of the barrel.

2. A writing implement as claimed in claim 1 and further comprising:

a plurality of axially extending slots through a part of the length of said carrier to provide a plurality of resilient elements engaging in the spiral groove.

3. A writing implement as claimed in claim 2 wherein:

said at least one carrier stop element comprises two of said stop elements extending oppositely from the longitudinal edges of the supporting member at the inner end thereof;

said guide element comprises a spiral thread conforming to and engaging in said spiral groove; and said cap has a part annular cap holder extending into the end of the barrel having an inner frusto-conical surface with the smaller diameter thereof at the end adjacent the cap and an axial slot through said cap holder.

4. A double ended writing implement comprising the writing implement as claimed in claim 3 at opposite end portions of the barrel.

* * * * *